United States Patent [19]

Wong et al.

[11] Patent Number: 4,688,006

[45] Date of Patent: Aug. 18, 1987

[54] PHASE COMPENSATED HYBRID COUPLER

[75] Inventors: Mon N. Wong, Torrance; Wilbur J. Linhardt, Hawthorne, both of Calif.

[73] Assignee: Hughes Aircraft Company, Los Angeles, Calif.

[21] Appl. No.: 782,677

[22] Filed: Oct. 2, 1985

[51] Int. Cl.[4] ..... H01P 5/18; H01P 1/18

[52] U.S. Cl. ..... 333/113; 333/122; 333/157; 333/248

[58] Field of Search ..... 333/1, 4, 5, 100, 109, 333/113, 248, 114, 117, 122, 124, 136–137, 156, 157; 343/776–778

[56] References Cited

U.S. PATENT DOCUMENTS 2,739,288 3/1956 Riblet ..... 333/113

3,423,688 1/1969 Seidel ..... 333/117 X

*Primary Examiner*—Marvin L. Nussbaum

*Attorney, Agent, or Firm*—Joseph A. Sawyer, Jr.; Mark J. Meltzer; A. W. Karambelas

[57] ABSTRACT

A phase compensated waveguide hybrid coupler is formed with a pair of waveguides of rectangular cross section and sharing a common short wall. An aperture in the short wall provides for the coupling of electromagnetic energy between a first of the waveguides and a second of the waveguides. Such coupling introduces a 90° phase shift. An input terminal is located at an end of the first waveguide. Phase compensation is introduced by a set of capacitive irises located in the first waveguide and by a set of inductive irises located in the second waveguide. The capacitive and inductive irises are located on a side of said coupling aperture away from said input terminal.

8 Claims, 5 Drawing Figures

PHASE COMPENSATED HYBRID COUPLER

BACKGROUND OF THE INVENTION

This invention relates to hybrid couplers which introduce an inherent guadrature relationship, or 90° phase shift, to electromagnetic waves coupled between two waveguides and, more particularly, to a coupling device including phase shifters in each waveguide to compensate for the 90° phase shift.

Hybrid couplers are widely used in microwave circuits for coupling a portion of the electromagnetic energy in one waveguide to another waveguide. In some cases, the coupling ratio is one-half so as to produce an equal split of the power among the two waveguides. In other cases, a smaller amount of the power such as one-quarter or one-tenth of the power may be coupled from one waveguide to the second waveguide. In a common form of coupler, known as a hybrid coupler, the two waveguides are brought contiguous to each other and in parallel relationship so as to share a common wall. An aperture in the common wall provides for the coupling of the electromagnetic energy.

A problem arises in that the hybrid coupler introduces a 90° phase shift to an electromagnetic wave coupled from the first waveguide to the second waveguide. In many power splitting situations, such as in the corporate feed for a phased-array antenna, it is desirable to maintain equality of phase between the electromagnetic waves in the two waveguides. Due to the presence of the 90° phase shift, or quadrature relatioship, between the waves in the two waveguides, it becomes necessary to introduce a phase correction to the radiant energy of the two waveguides.

One solution to this problem has been the introduction of a phase shifter into the first waveguide, downstream from the coupling aperture, to equalize the phase shifts in the two waveguides. The 90° phase shift in the second waveguide is a phase lag and, accordingly, the phase shifter comprises a series of capacitive elements disposed along the first waveguide.

The foregoing solution to the problem suffers from the disadvantage that a capacitive phase shifter of sufficient length to introduce the required 90° phase shift is unduly long and heavy for use in a microwave network for feeding an antenna. Such microwave networks typically have numerous waveguide branches. Thus, the introduction of additional length and weight to the components of the network causes a significant enlargement of the entire network which renders the network less favorable for installation in mobile applications such as with antennas carried by satellites. Yet a further disadvantage of the foregoing solution is the fact that such phase shifters have proven to be highly dependent on frequency with the resultant phase shift being frequency dispersive. Accurate compensation for the quadrature relationship has only been obtained for a single value or narrow range of frequency. Accordingly, the foregoing problem of the unwanted phase shift has not been resolved in a manner which allows for the reduction in size and weight of the microwave components.

SUMMARY OF THE INVENTION

The foregoing problem is overcome and other advantages are provided by the phase compensated waveguide hybrid coupler in which two waveguides are positioned in side by side relation, each of the waveguides being formed of metallic walls arranged with a rectangular cross section having two long walls joined by two short walls. The two waveguides share a common short wall. A coupling aperture is located within the common short wall to provide the hybrid coupling. A phase shift of −90° is introduced inherently by the hybrid coupling of electromagnetic energy from the first waveguide to the second waveguide via the aperture in the common wall. An input terminal of the coupler is located in the first waveguide on one side of the coupling aperture. Two output terminals are provided for the hybrid coupler, these output terminals being a through port located in the first waveguide and a coupled port being located in the second waveguide on a side of the coupling aperture away from the input terminal.

In accordance with the invention, phase compensation is attained by constructing a first phase shifter in the first waveguide adjacent the through port, and a second phase shifter in the second waveguide adjacent the coupled port. The first phase shifter is constructed of a set of capacitive irises located on a long wall of the waveguide and introducing a phase shift of −45°. The second phase shifter is constructed of a set of inductive irises disposed on a short wall of the waveguide and extending between the two long walls of the waveguide to provide +45° phase shift. The algebraic summation of the +45° compensatory phase shift with the −90° inherent phase shift introduces a net −45° phase shift in the second waveguide, which phase shift is equal to the −45° phase shift of the first waveguide. Each of the waveguides is provided with an abutment disposed on the short wall opposite the coupling aperture to provide a reduced cross section which enhances the coupling of the radiant energy via the coupling aperture. The abutments are constructed as a series of steps which are sufficiently small relative to the free space wavelength so as to introduce no more than a negligibly small reflection coefficient. The foregoing configuration of the compensated hybrid coupler is sufficiently wide band to allow for separate transmit and receive communication channels for use in satellite communications.

BRIEF DESCRIPTION OF THE DRAWING

The foregoing aspects and other features of the invention are explained in the following description taken in connection with the accompanying drawing wherein.

DETAILED DESCRIPTION

Figure 1:
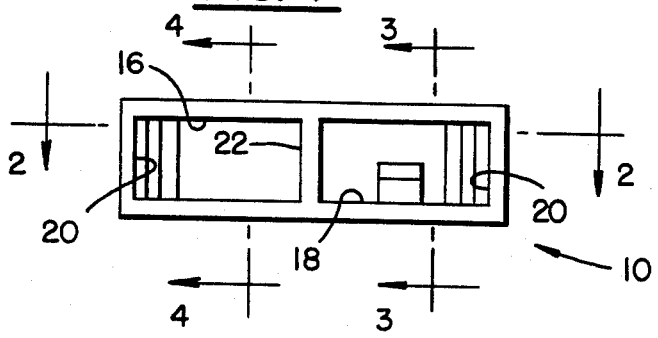
FIG. 1 is an end view of the compensated coupler of the invention.
Figure 2:
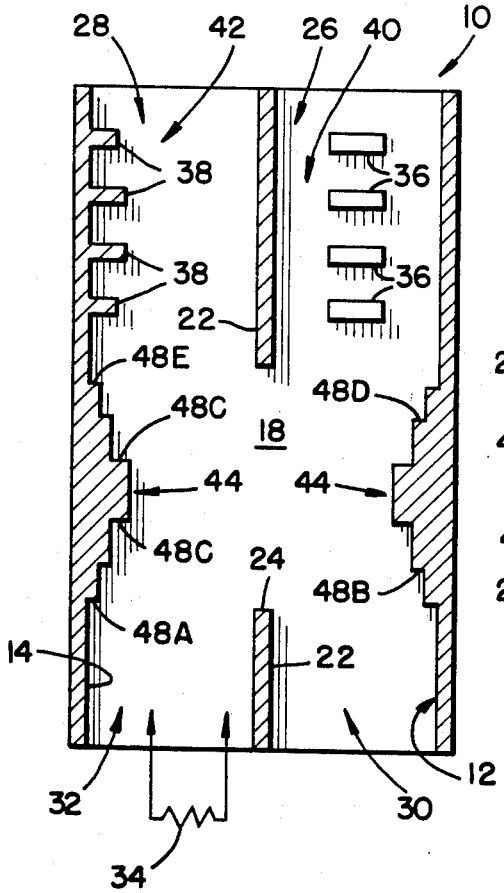
FIG. 2 is a plan view of the coupler sectioned along the line 2—2 of FIG. 1.
Figure 3:
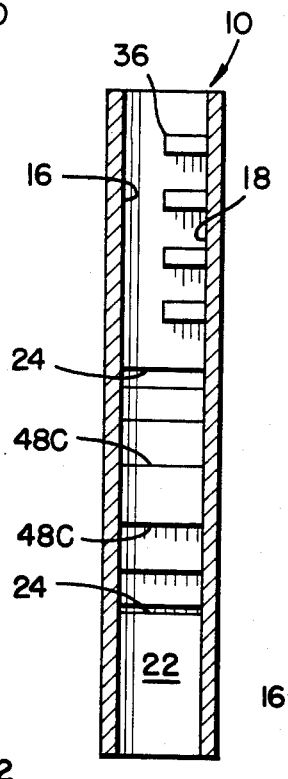
FIG. 3 is a longitudinal sectional view of the coupler taken along the line 3—3 in FIG. 1.
Figure 4:
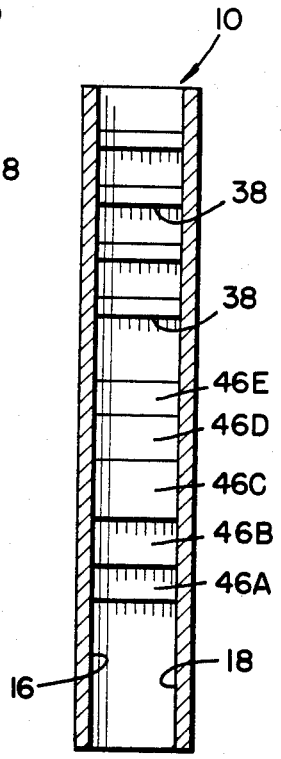
FIG. 4 is a longitudinal sectional view of the coupler taken along the line 4—4 of FIG. 1.

With reference to FIGS. 1–4, a hybrid coupler 10 is constructed in accordance with the invention for the coupling of electromagnetic energy. The coupler 10 is formed of a first waveguide 12 and a second waveguide 14, each of which have rectangular cross-sectional form wherein the ratio of a long wall to a short wall is 2:1. For operation at a microwave frequency of 12 GHz (gigahertz), waveguide type WR-75 is employed. Each of the waveguides have two long walls, namely a top wall 16 and a bottom wall 18, which are joined by short walls, namely outer sidewalls 20 and a common wall 22 which serves as an inner sidewall for each of the two waveguides 12 and 14. The coupler 10 is a very broad band device which, in the preferred embodiment of the invention has an operating range extending from 11.7 GHz to 14.5 GHz.

In accordance with the invention, the coupler 10 provides the dual functions of hybrid coupling plus phase compensation of electromagnetic energy between the two waveguides 12 and 14. The coupling of the electromagnetic energy is accomplished by a gate 24 located in the common wall 22. For 3 dB (decibels) coupling, the gate 24 is always opened and has a fixed length approximately equal to one free-space wavelength of the electromagnetic energy, as measured along a longitudinal axis of either waveguide 12 or 14. For lesser amounts of coupling, the length of the gate 24 is reduced, for example, to 0.8 waveguide for 6 dB coupling.

The coupler 10 has two output terminals, shown as a through port 26 and a coupled port 28, and located at ends of the waveguides 12 and 14 respectively. The coupler 10 further comprises an input port 30 located at an end of the first waveguide 12 opposite the through port 26, and an isolation port 32 located at an end of the second waveguide opposite the coupled port 28. The isolation port 32 is shown connected schematically to a resistor 34 which represents a nonreflecting load having an impedance matched to that of the second waveguide 14. Such a load (not shown) is constructed typically in the form of a well-known wedge which absorbs electromagnetic energy at the operating frequency of the coupler 10, and is conveniently mounted within a section of waveguide (not shown) connected to the isolation port 32 by flanges (not shown). In use, the coupler 10 would be connected to components of a microwave circuit (not shown); such components may include waveguide fittings which would be connected in a conventional manner, as by flanges (not shown) to the ports 26, 28, and 30 of the coupler 10.

The arrangement of the coupling gate 24 in the common sidewall 22 of the two waveguides 12 and 14 provides the configuration of a guadrature sidewall short slot hybrid coupler. Microwave signals coupled between the two waveguides via the gate 24 undergoes a lagging 90° phase shift, this phase shift being inherent in the well-known operation of a quadrature sidewall short slot hybrid coupler. In many microwave circuits, such as those of a phased array antenna, such phase shift is unwanted, and some sort of phase compensation is required to equalize the phase between the microwave signals of the two waveguides 12 and 14.

The invention provides the requisite phase compensation by use of a set of four capacitive irises 36 located in the first waveguide 12 beyond the gate 24, and a set of four inductive irises 38 located in the second waveguide 14 beyond the gate 24. The configuration of the capacitive irises 36 in the waveguide 12 constitutes a phase shifter 40 which introduces a lagging phase shift of 45° at the through port 26. The configuration of the inductive irises 38 in the waveguide 14 constitutes a phase shifter 42 which introduces a leading phase shift of 45° at the coupled port 28. The combination of the −90° shift introduced at the gate 24 with the +45° shift introduced by the shifter 42 provides a net −45° shift at the coupled port 28 which balances the −45° shift introduced by the shifter 40 at the through port 26. In order to use the coupler 10 in certain situations, such as a microwave circuit handling two-way communication via an antenna carried by a satellite, it is desirable to construct the coupler 10 with a bandwidth wide enough to accommodate a transmit channel and a receive channel spaced apart in the frequency domain by an empty band which prevents cross talk between the two channels. The increased bandwidth of the coupler 10 is attained by use of stepped abutments 44 located at the outer sidewalls 20 on a center line of the gate 24. The abutments 44 reduce the width of the waveguides 12 and 14 at the gate 24 to enhance coupling of radiant energy via the gate 24.

Each of the abutments 44 is composed of three tiers having steps 46A–E and risers 48A–E. The dimensions of an abutment 44 may be adjusted to attain a desired bandwidth. Typical dimensions in terms of the free-space wavelength are as follows. The overall length is $1\frac{1}{4}$ wavelength, the step 46C is $\frac{1}{2}$ wavelength, the steps 46B and 46D are each $\frac{1}{4}$ wavelength and the steps 46A and 46E are each $\frac{1}{8}$ wavelength. The risers 48A and 48E are each 0.050 inches, the risers 48B and 48D are each 0.045 inches, and the risers 48C on both sides of the step 46C are each 0.060 inch. It is noted that each of the risers is less than 1/10 of a wavelength so as to minimize reflections from the abutments 44.

With respect to the construction of the phase shifter 40, the two center irises 36 have an equal height of $\frac{1}{8}$ wavelength, this being 0.110 inch at the operating frequency of the coupler 10. The remaining two irises 36, at the ends of the set of irises, have an equal length of approximately 1/16 wavelength, the length measuring 0.080 inch at the operating frequency of the coupler 10, this being shorter than the height of the central irises 36. The thickness of each of the irises 36, as measured along the axis of the waveguide 12, is $\frac{1}{8}$ wavelength. The spacing on centers between successive ones of the irises 36 is $\frac{1}{4}$ of the guide wavelength. The width of each of the irises 36, as measured in a direction transverse to the waveguide axis, is approximately 0.2 inch. The length of the segment of the wall 22 adjacent the capacitive irises 36 is 1.7 inch. The capacitive irises 36 are centrally spaced between the two sidewalls 20 and 22. While the capacitive irises 36 are shown as extending upwardly from the bottom wall 18, it is noted that, alternatively, they may be constructed as extending downwardly from the top wall 16.

With respect to the construction of the phase shifter 42, the two center inductive irises 38 extend from the outer sidewall 20 a distance of 0.115 inch, and the remaining two irises 38 at the outer ends of the set of irises extend from the sidewall 20 a shorter distance, namely 0.110 inch. The spacing between centers of the inductive irises 38 is $\frac{1}{4}$ of the guide wavelength. The thicknesses of the inductive irises 38, as measured along an axis of the waveguide 14, is approximately $\frac{1}{8}$ free-space wavelength.

Other dimensions of the coupler 10 are as follows. The section of the common wall 22 adjacent the input port 30 measured 0.7 inch. The spacing between the sidewalls 20 and 22 in each of the waveguides 12 and 14 is 0.75 inch, this being approximately $\frac{3}{4}$ wavelength. The overall length of the coupler 10 is 3.6 inch.

In the construction of the coupler 10, brass or aluminum is employed in the fabrication of both the waveguide walls as well as the irises 36 and 38, and the abutments 44. Both of the metals provide adequate electrical conductivity, the aluminum being employed when it is desired to reduce weight. Both the abutments 44 and the inductive irises 38 extend the full distance between the top wall 16 and the bottom wall 18. While capacitive irises can be constructed which extend the full distance between the short walls, the desired phase shift and bandwidth has been obtained in the preferred embodiment by constructing the capacitive irises 36 with a width, as noted above, which extends only partway the two sidewalls 22 and 20 of the first waveguide 12.

In operation, the coupler 10 operates as a Ku-band sidewall short slot hybrid coupler with phase compensation introduced into the output terminals 26 and 28. The phase compensation is non-dispersive in frequency, and the phase shift structures permit the construction of the coupling device in a compact light-weight assembly for use in broadband power division networks. The capacitive phase shifter 40 introduces a phase shift of −45° at the through port 26. The inductive phase shifter 42 introduces a +45° phase shift in the second waveguide 14, which phase shift is algebraically combined with the −90° phase shift introduced by the hybrid coupling. The algebraic combination of the +45° phase shift and the −90° phase shift in the second waveguide 14 produces a resultant phase shift of −45° at the coupled port 28, this resultant phase shift being equal to the −45° phase shift at the through port 26. Thus, upon the application of radiant energy to the input port 30, the resultant electromagnetic waves exiting the through port 26 and the coupled port 28 are in phase with each other.

Figure 5:
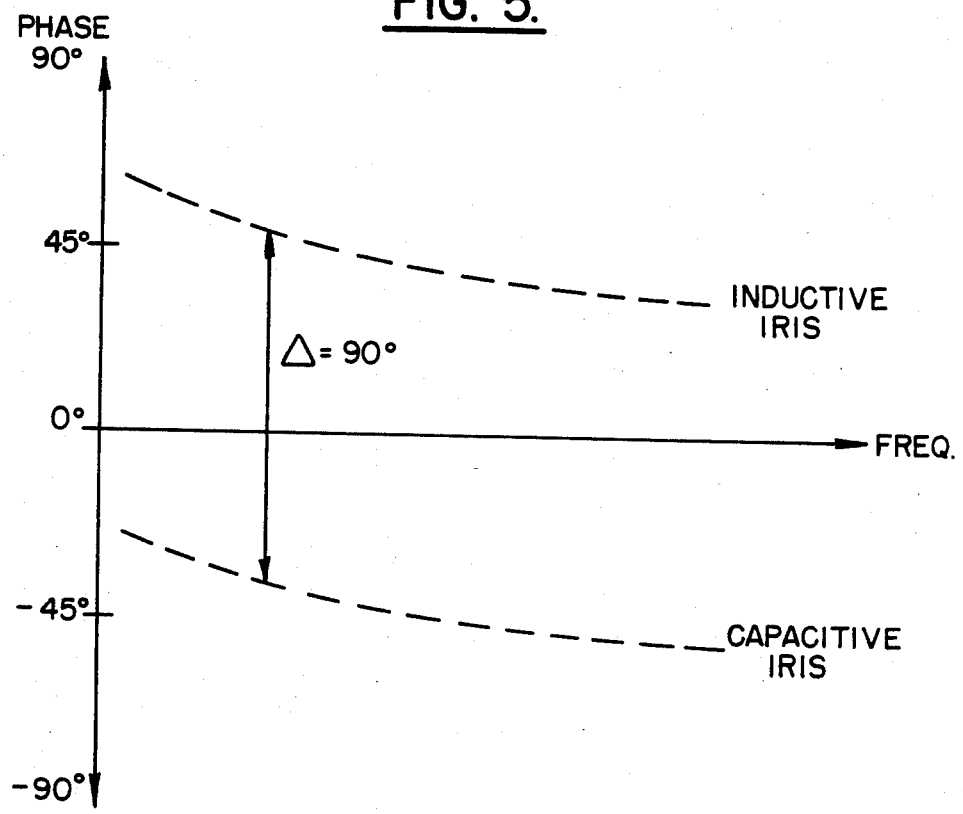
FIG. 5 is a graph of phase shift versus frequency for each of two phase shifting sections of the compensated coupler.

FIG. 5 shows a feature of the invention wherein the frequency dispersive characteristics of the phase shifter 40 and 42 track each other. As is well known, the phase shift introduced by a phase shifter at one frequency differs somewhat from the phase shift introduced at another frequency. The coupler 10 is to be employed over a wide range of frequencies and, accordingly, any frequency dependency of phase shift must also be corrected. While the nominal values of phase shift of the inductive iris 38 and the capacitive iris 36 are +45° and −45°, respectively, the actual values of phase shift vary from the nominal value as a function of frequency. As shown in FIG. 5, the inductive phase shifter 42 introduces a phase shift in excess of +45° at lower values of frequency, the value of phase shift dropping towards the nominal value for higher values of frequency. The phase shift introduced by the capacitive phase shifter 40 is smaller than the nominal value for lower values of frequency, and increases to the nominal value at higher frequencies.

However, in accordance with an important feature of the invention, the difference between the phase shifts introduced by the series of inductive irises and the series of capacitive irises remains constant at 90° over the range of frequencies in the band of interest. Thus, the coupler 10 compensates for frequency induced variations in phase shift so as to provide for a broadband compensation of the inherent 90° phase shift associated with a hybrid coupler. As shown in FIG. 5, the upper trace for the series of inductive irises accurately tracks the lower trace representing the series of capacitive irises. Thereby, the phase compensation of the coupler 10 attains a major advantage over previously available phase compensatory devices in that the compensation of the invention is free of frequency dispersion. This advantage is attained in conjunction with the mechanical benefit of reduced package size and reduced weight.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A phase compensated waveguide hybrid coupler comprising:

a first waveguide and a second waveguide;

means for coupling radiant energy between said first and second waveguide, said coupling means introducing a predetermined phase shift to radiant energy coupled by said coupling means from said first waveguide to said second waveguide;

a first phase shifter located in said first waveguide, said first phase shifter introducing a first compensatory phase shift having the same sign as said predetermined phase shift; and second phase shifter located in said second waveguide, said second phase shifter introducing a second compensatory phase shift opposite in sign to said predetermined phase shift, such that the algebraic sum of said predetermined phase shift and said second compensatory phase shift imparted to radiant energy in said second waveguide is equal to the amount of said first compensatory phase shift imparted to radiant energy in said first waveguide.

2. A coupler according to claim 1 wherein each of said waveguides comprises metallic walls assembled with a rectangular cross section comprising a long wall and short wall, said coupling means engaging with each of said waveguides via a short wall in respective ones of said waveguides.

3. A coupler according to claim 2 wherein said first and said second waveguides are contiguous each other and share a short wall as a common short wall, said coupling means comprising an aperture in said common wall.

4. A coupler according to claim 3 further comprising an input terminal located in said first waveguide, said first phase shifter comprising a plurality of capacitive irises disposed along one of said long walls, said capacitive irises extending partway from one of said long walls to the other of said long walls and being spaced apart from both of said short walls.

5. A coupler according to claim 3 further comprising an input terminal located in said first waveguide, said second phase shifter comprising a plurality of inductive irises disposed along one of said short walls and extending from one of said long walls to the other of said long walls.

6. A coupler according to claim 5 wherein said first phase shifter comprises a plurality of capacitive irises disposed along one of said long walls, said capacitive irises extending partway from one of said long walls to the other of said long walls and being spaced apart from both of said short walls.

7. A coupler according to claim 6 wherein said first and said second phase shifters are located on a side of said coupling means opposite said input terminal.

8. A coupler according to claim 7 further comprising means for reducing the cross section of each of said waveguides at said coupling means to enhance the coupling of radiant energy between said first waveguide and said second waveguide.

* * * * *